United States Patent [19]

Gomez

[11] 4,009,844

[45] Mar. 1, 1977

[54] SPRING REWOUND TAGLINE DEVICE HAVING A MECHANISM FOR CONTROLLING THE UNWINDING OF THE SPRING

[75] Inventor: Secundino G. Gomez, Los Angeles, Calif.

[73] Assignee: McCaffrey-Ruddock Tagline Corporation, Los Angeles, Calif.

[22] Filed: Sept. 11, 1975

[21] Appl. No.: 612,331

[52] U.S. Cl. ..... 242/107.3

[51] Int. Cl.[2] ..... B65H 75/48

[58] Field of Search ..... 214/657, 139; 242/107 R, 107.3, 99, 84.5; 188/76

[56] References Cited

UNITED STATES PATENTS

| | | | |
|---|---|---|---|
| 2,283,784 | 5/1942 | Billings | 242/106 |
| 2,412,412 | 12/1946 | Meili | 242/107.3 |
| 3,237,878 | 3/1966 | Van Evera | 242/107.3 |
| 3,586,135 | 6/1971 | Ostwald | 188/76 |
| 3,608,386 | 9/1971 | Pambid et al. | 188/76 |

*Primary Examiner*—Harry N. Haroian
*Attorney, Agent, or Firm*—Paul A. Weilein

[57] ABSTRACT

A spring rewound tagline device having a mechanism in the form of a brake for controlling unwinding of the spring and its operation of a connected cable reel, with the brake being selectively operable to engage a peripheral portion of an associated member arranged for rotation with the reel. Manipulation of the brake permits the reel to be locked against rotation, and the spring held against unwinding, or permits rotation of the reel in a regulated manner to control unwinding of the associated spring.

7 Claims, 3 Drawing Figures

SPRING REWOUND TAGLINE DEVICE HAVING A MECHANISM FOR CONTROLLING THE UNWINDING OF THE SPRING

BACKGROUND OF THE INVENTION

The present invention relates to a spring rewound tagline device, and more particularly to a mechanism for controlling unwinding of the spring in a spring rewound tagline device.

Spring loaded tagline rewound devices for use with cranes, and the like, have heretofore been known generally from U.S. Pat. No. 2,303,002, issued Nov. 24, 1942 to W. J. Ruddock, and U.S. Pat. No. 2,645,432, issued July 14, 1953, and Pat. No. 3,062,479, issued Nov. 6, 1962, both to H. V. Griffitts, which employ a coiled torsion spring connected between a movable core and a hollow, generally cylindrical housing surrounding the core to supply the power that rewinds a tagline, electrical cable, and the like, onto a reel operatively connected to the movable core. By anchoring the coiled torsion spring at one end to a fixed element, such as the housing of the device, and at the other end to a rotatable part, such as the reel by means of the core, the spring is wound, or tensioned, responsive to rotation of the reel in one direction so as to resiliently rewind the reel in an opposite direction as the load on the tagline, or other cable, is relieved.

A problem encountered with such conventional tagline devices, however, is that a substantial amount of tension may remain on the spring when it is necessary or desirable to perform maintenance or repair work on the tagline device, or detach it from a controlled device. The presence of such tension on the spring is inherently dangerous to the personnel performing such maintenance and/or repair work, and creates a definite safety hazard. Further, doubt as to the amount of tension remaining on the spring requires at least three men to perform a disengagement of a tagline or electric cable from a bucket, magnet, or similar implement being controlled and actuated by the tagline device. It is therefore a customary practice to always position one man adjacent the reel, or reels, associated with the tagline device for placing, and subsequently removing a wood block, and the like against a gusset provided on the interior side of the cable reel, while two men are required to safely walk-in the cable. As will be appreciated, this procedure is inefficient, time consuming, and expensive.

Accordingly, the present invention proposes to provide a brake arrangement for controlling or regulating the unwinding of the spring, and accompanying rewinding of a tagline or other cable on the reel.

U.S. Pat. Nos. 2,283,784 and 2,382,955, issued May 19, 1942 and Aug. 21, 1945, respectively, to R. O. Billings, disclose tagline reels of the coiled torsion spring type which employ a brake band and drum assembly to retard movement of the reel when the tagline is being payed-out. These brake assemblies are intended to release when the torsion spring is rewinding the tagline onto the reel, and accordingly are unsuited for holding the reel against movement, or controlling the unwinding of the torsion spring during rewinding of the tagline or cable on the reel.

SUMMARY OF THE INVENTION

It is an object of the present invention to provide a spring rewound tagline device which includes a mechanism for controlling unwinding of the torsion spring and the rewinding of the tagline.

It is another object of the present invention to provide a spring tagline device in which the rewinding of a detached tagline can be accomplished by a single operator.

It is yet another object of the present invention to provide a spring rewound tagline device in which a torsion spring under tension can be retained in its loaded mode, or can be released from tension at desired rate.

These and other objects are achieved according to the present invention by providing a mechanism in which a drum member is connected for rotation with a spring rewound tagline reel and an operatively associated brake assembly is provided for selectively engaging the drum to restrain rewinding movement of the reel and unwinding of the connected torsion spring, as well as regulatory control over the unwinding, or relieving, of tension on the torsion spring.

The brake assembly includes a caliper type brake which is mounted on the tagline device and includes a pair of jaws arranged to grippingly engage a peripheral, or flange portion of the drum. The flange portion is preferably annular so as to provide a continuous surface of curvature for engagement by the jaws.

These and other objects and advantages of the invention will become subsequently apparent from the details of construction and operation of the invention as more fully described and claimed below.

DESCRIPTION OF THE PREFERRED EMBODIMENT

Figure 1:
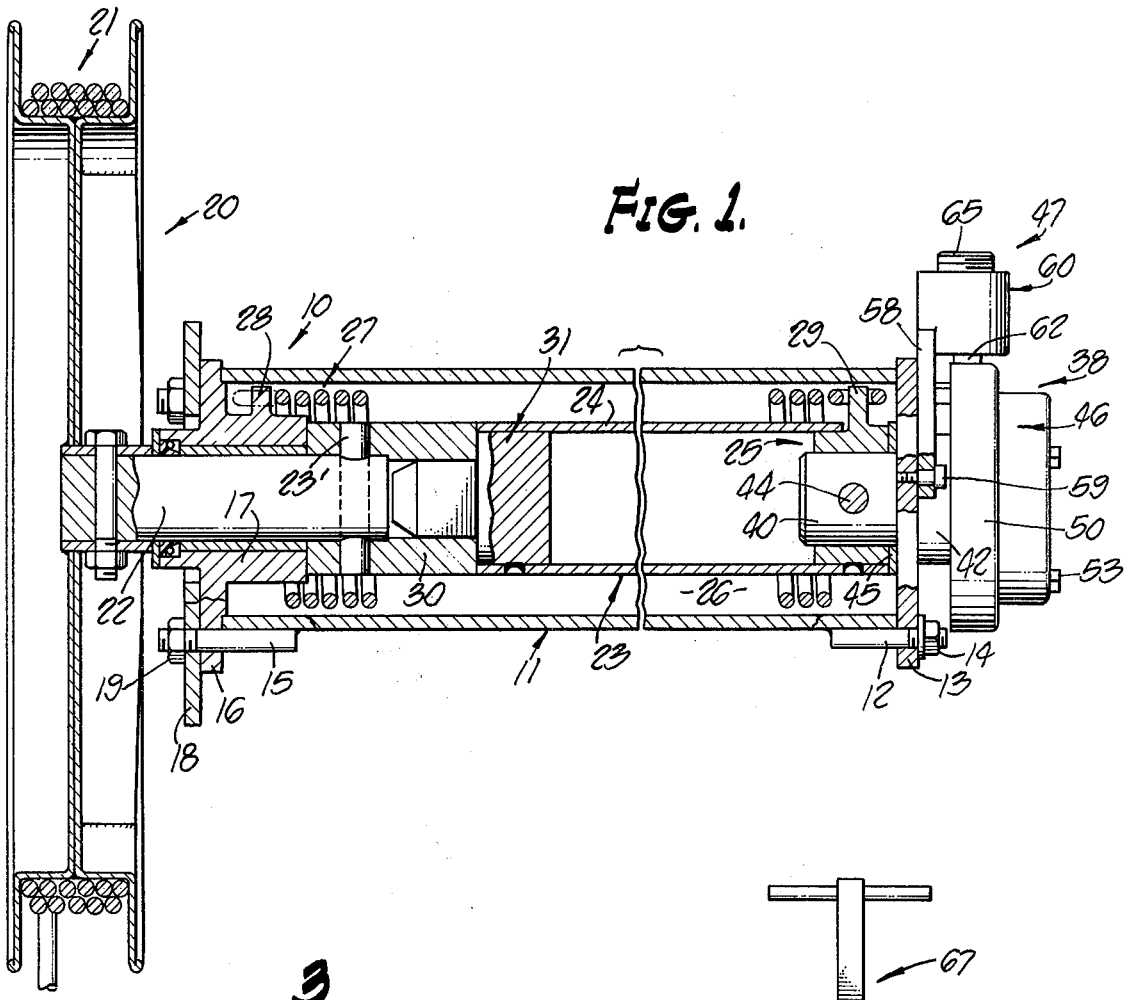
FIG. 1 is a longitudinal sectional view of a spring rewound tagline device embodying a spring unwinding control mechanism according to the present invention.

Referring more specifically to the drawing, for illustrative purposes, there is shown in FIG. 1 a spring rewound tagline device 10 which is arranged to be mounted on the boom of a crane for the purposes which are well known in the art, by means of appropriate brackets, U-shaped clamps, and the like (not shown).

The tagline rewind device may vary as to specific structure, but for purposes of illustration has been shown herein as comprising a fixedly mounted hollow housing 11 in the form of an elongate cylinder. At one end, the housing is provided with a plurality of threaded stems 12 which are welded or othewise secured and project beyond the housing end for connection with an end plate or closure 13 as by means of nuts 14 threaded on the stems 12. At the opposite end, the housing 11 is similarly provided with projecting threaded stems 15 extending through a radially projecting flange 16 of a fixed bushing 17, and through a plate member 18, which may form a fixed support for an associated part of the device, the flange 16 and plate member 18 being secured to the housing as by nuts 19 threaded onto the stems 15.

A cable reel 20 for a tagline or cable 21 is rotatably mounted by being secured to a shaft 22 which is rotatably supported within the bushing 17, this shaft projecting inwardly beyond the bushing and being fixedly secured to one end of an elongate core structure 23 as by a key pin 23'. The core structure includes an elongated tubular member 24 which has its right end, as shown in FIG. 1, fixedly secured to a rotatably mounted annular member 25, adjacent the end plate 13.

As thus arranged, the core structure 23 and the housing 11 are in radially spaced concentric relation and coact to form an elongated annular space 26 within which there is mounted a coiled torsion spring 27. One end of this spring is hooked or otherwise connected to a radially outstanding lug 28 formed on the periphery of the fixed bushing 17, while the other end of the spring is hooked or otherwise connected with an outstanding lug 29 formed on the periphery of the annualar member 25. With his arrangement, it will be apparent that rotation of the reel 20 in a direction to pay-out the cable or tagline 21 will operate through the core structure 23 to rotate the annular member 25 in a direction to tension the torsion spring 27, and that when the payed-out tagline is relieved, the tensioned torsion spring will act to rewind the tagline on the reel 20.

The annular space 26 also serves to provide a resevoir for an appropriate lubricating oil, and the like, not shown in the drawing, as conventionally employed in tagline devices such as described herein as a lubricating and dampening medium.

The structure thus far described is more or less conventional and forms no part of the present invention except insofar as it constitutes environment for the novel features comtemplated herein. The previously mentioned U.S. Pat. No. 3,062,479, issued Nov. 6, 1962 to H. V. Griffitts, is in general exemplary of the structure which has thus far been described.

A primary and important feature of the present invention resides in the provision of a mechanism, as generally indicated by the numeral 38, which is so arranged that it may be actuated to lock the reel 20 against rewinding rotation, or which may be operated so as to permit rotation of the reel in a regulated manner to control the rewind at a predetermined rate.

For such purpose, a stub shaft 40 is rotatably supported within a bearing bushing 42 which is formed as a part of the end plate 13, a suitable seal 43 being provided in the bushing so as to surround the shaft and prevent leakage of the lubricating medium contained in the annular space 26. The innermost end of this shaft is fixedly secured within the internal bore of the annular member 25 as by a key pin 44, and the outermost end of the shaft 40 projects outwardly beyond the bushing 42. Preferably, a thrust washer 45 is interposed between the annular member 25 and the adjacent end plate 13.

Figure 2:
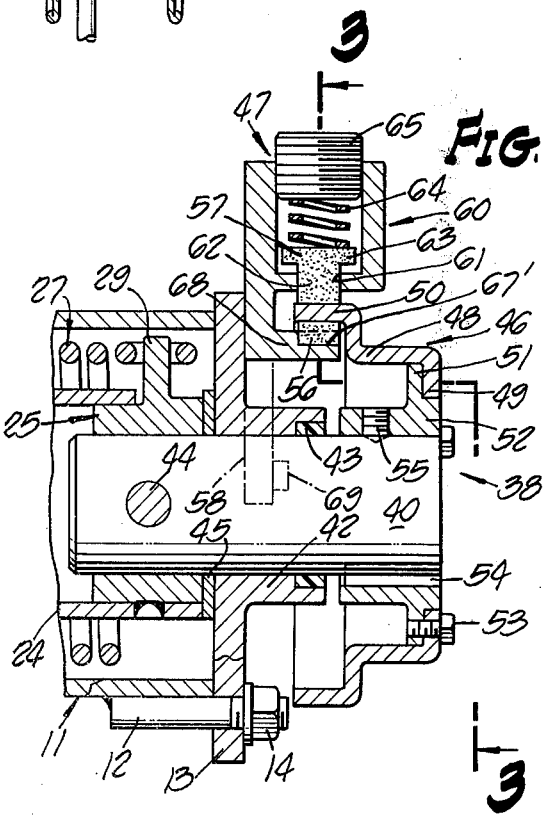
FIG. 2 is an enlarged fragmentary sectional view of the right hand end of the device of FIG. 1.
Figure 3:
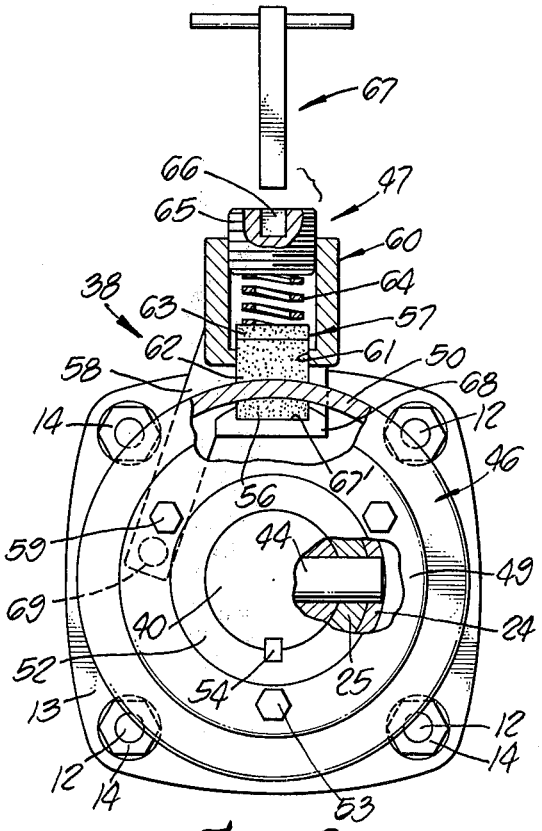
FIG. 3 is a sectional end view taken generally along the line 3—3 of FIG. 2.

More specifically, the mechanism 38 takes the form of braking means, wherein as best shown in FIG. 2, a brake drum 46 is operatively associated with a braking device assembly 47. The braking drum may vary as to configuration, but in the present arrangement is shown as comprising a cup-shaped member 48 which is stepped between its ends and provided with a radially inwardly extending flange 49 at one end, and a circumferentially extending flange 50 of relatively greater diameter at its other end. The flange 49 is secured to a peripheral outwardly extending radial flange 51 of a hub member 52, as by retaining bolts 53. This hub member is secured to the outer end of the stub shaft 40 as by a key 54 and a set screw 55. As thus arranged, the cupped member 58 extends inwardly from the outer end of the shaft 40, and the circumferential flange 50 is in concentric spaced relation surrounding the bearing bushing 42. It will be apparent, that the cup-shaped member 48, as thus connected, will rotate as a unit with the cable reel 20, and that any restrictive forces applied to the member 48 will correspondingly affect the rotation of the cable reel.

The braking device assembly is of the caliper type and includes a fixed shoe or jaw 56 for engaging the inner surface of the flange 50, and a movable jaw or shoe 57 for engaging the outer surface of the flange 50. These braking shoes are supported by a bracket structure which includes an arm 58 which has one end pivotally mounted on the outer surface of the end plate 13 by means of a pivot stud bolt 59. At its outermost end, the arm 58 carries an integrally formed cylindrical casing 60 having a bottom wall with an opening 61 for receiving therethrough an end portion 62 of the movable shoe 57, this end portion extending from an enlarged head portion 63 positioned within the casing 60. The end portion 62 is arranged to bear against the outer surface of the flange 50 and for this purpose is formed with a concave surface of engagement. The head portion 63 is engaged by one end of a compression spring 64, the other end of this spring being engaged by an adjustable screw plug 65 having threaded engagement with the uppermost end of the cylindrical casing 60. Preferably, the plug 65 is formed with a recess 66 in its outermost end for the reception of an actuating T-handle 67 or other suitable tool whereby the plug 65 may be manually adjusted to vary the spring force acting on the movable jaw 57 so as to adjust its braking effect with respect to the flange 50.

The fixed shoe 56 is supported in a recess 67' of a projecting integrally formed leg portion 68 which is positioned below the cylindrical casing 60 and underlies the flange 50 so as to support the shoe 56 in a position in which its upper convex surface of engagement will properly contact the inner surface of the flange 50.

The pivotal mounting of the arm 58 permits the braking jaws or shoes to automatically accommodate and assure proper seating of the shoes on the flange 50. The pivotal movement further acts to compensate for wear upon these jaws. In practice, a second opening, as indicated at 69, may be provided in the arm 58 to permit angular shifting of the arm 58 and the relative position of the shoes 56 and 57 circumferentially of the flange 50, when desired.

In operation, it will be appreciated that the gripping action of the jaws 56 and 57 against the flange 50 may be varied by adjusting the plug 65 and thus change the bias effect of the spring 64, and thus permit an operator to variably control the release of tension on the torsion spring 27, as desired. For example, by appropriate clamping of jaws 56 and 57 against the flange 50, it is possible to totally prohibit the drum 46, the connected core structure 23, and the reel 20 from rotation, regardless of the tension present on the spring 27. By relieving the bias effect of the spring 64 on the jaw 56 and the jaw 57, connected reel 20 may be permitted to rotate at a desire rate, when the tagline or cable is being rewound. In this manner, a single operator with the aid of possibly one assistant can manipulate the plug 65, as by the use of handle 67, and safely disengage and retrieve a tagline or electric cable from a bucket, magnet, or similar implement being controlled by the tagline device.

As will be appreciated from the above description and from the drawing, a rotation control arrangement according to the present invention permits a single operator to easily, efficiently, and safely control the release of tension on the torsion spring, or to retain the tension on the torsion spring, when appropriate maintenance and repair work is being performed on the tagline device.

It is to be understood that the above description of the present invention is susceptible to various modifications, changes, and adaptations intended to be interpreted within the meaning and range of equivalents of the appended claims.

What is claimed is:

1. In a spring rewound tagline device in which a rotatably mounted tagline reel is activated in a rewind direction by a tensioned torsion coiled spring:

mechanism for controlling the rewinding actuation of the reel by the unwinding action of the torsion spring, when the outer load connection end of the tagline is detached, said mechanism, comprising:

a. a braking member connected for rotation with the reel; and b. a braking device assembly supported on the tagline device including:

1. a casing;
2. braking shoe means guidingly supported by said casing for axial movement to a position in engagement with said braking member;
3. spring means continuously urging said shoe means towards said position of engagement; and
4. manually operable means carried by said casing for selectively varying the effective force of said spring and the concommitant braking effect by said shoe means.

2. A tagline device according to claim 1, in which one end of said torsion spring is connected to said reel for unitary rotation therewith, and said one end is supported by a rotatable stub shaft; and in which the braking member is a braking drum secured to said stub shaft.

3. A tagline device according to claim 2, wherein the braking device assembly is of a caliper type and includes a pair of shoes urged by said spring means in opposite directions to positions of engagement with opposite surfaces of a peripheral portion of the braking drum member.

4. A tagline device according to claim 3, wherein the braking device assembly is pivotally supported on the tagline device, and said casing is cylindrical and guidingly supports at one end one of said shoes for axial movement towards its position of engagement with said drum; in which said manually operable means includes a plug threadingly engaged with the opposite end of said casing; and in which said spring means is a compression spring in said casing having one end engaged with said plug and its other end engaged with said shoe, said plug being adjustable to variably change the biasing action of said spring and the braking effect of the associated shoes.

5. A tagline device according to claim 4, wherein the other of said shoes is supported at a fixed spaced distance from said casing, and in axial operating alignment with said one of said shoes.

6. A tagline device as defined in claim 4, which includes a handle actuator releasably engageable with said plug for rotating the same to adjustably vary the bias effect of said compression spring.

7. A tagline device as defined in claim 3, wherein the other of said shoes is fixedly supported on the casing, and said compression spring urges both of said shoes towards their positions of engagement with said drum.

* * * * *